US010902990B2

(12) United States Patent
Oh et al.

(10) Patent No.: US 10,902,990 B2
(45) Date of Patent: Jan. 26, 2021

(54) COIL COMPONENT AND METHOD FOR MANUFACTURING SAME

(71) Applicant: SAMSUNG ELECTRO-MECHANICS CO., LTD., Suwon-si (KR)

(72) Inventors: Yun Suk Oh, Suwon-si (KR); Jin Mo Ahn, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 218 days.

(21) Appl. No.: 15/818,130

(22) Filed: Nov. 20, 2017

(65) Prior Publication Data

US 2018/0286560 A1 Oct. 4, 2018

(30) Foreign Application Priority Data

Mar. 30, 2017 (KR) ..... 10-2017-0040688

(51) Int. Cl.
*H01F 27/28* (2006.01)
*H01F 27/29* (2006.01)
(Continued)

(52) U.S. Cl.
CPC ..... *H01F 27/28* (2013.01); *H01F 17/04* (2013.01); *H01F 27/255* (2013.01); *H01F 27/29* (2013.01);
(Continued)

(58) Field of Classification Search
CPC ..... H01F 27/28; H01F 27/29; H01F 27/255; H01F 27/32; H01F 27/292; H01F 27/073;
(Continued)

(56) References Cited

U.S. PATENT DOCUMENTS 7,692,527 B2 * 4/2010 Ito ..... H01F 17/0013 336/184
7,714,687 B2 * 5/2010 Marui ..... H01F 5/02 336/131
(Continued)

FOREIGN PATENT DOCUMENTS

JP H09-312232 A 12/1997
JP 2013-110184 A 6/2013
(Continued)

OTHER PUBLICATIONS

Notice of Office Action issued in Korean Patent Application No. 10-2017-0040688, dated Mar. 20, 2018 (English translation).
(Continued)

*Primary Examiner* — Mang Tin Bik Lian
(74) *Attorney, Agent, or Firm* — Morgan, Lewis & Bockius LLP

(57) ABSTRACT

A coil component includes a body having a winding coil and a plurality of guide members therein. The guide members are spaced apart from each other along an outer periphery of the winding coil, and each of the guide members has an exposed surface exposed externally of the body. A method for manufacturing a coil component includes seating opposing ends of a winding coil on a support member of a frame having guide members restricting movement of the winding coil relative to the frame. A body is formed that embeds the winding coil and at least a portion of each of the guide members therein, and the guide members restrict movement of the winding coil during the forming of the body.

19 Claims, 6 Drawing Sheets

(51) Int. Cl.
*H01F 41/10* (2006.01)
*H01F 27/255* (2006.01)
*H01F 41/04* (2006.01)
*H01F 27/32* (2006.01)
*H01F 17/04* (2006.01)

(52) U.S. Cl.
CPC ..... *H01F 27/292* (2013.01); *H01F 27/32* (2013.01); *H01F 41/04* (2013.01); *H01F 41/10* (2013.01); *H01F 2017/048* (2013.01)

(58) Field of Classification Search
CPC ..... H01F 27/2804; H01F 41/10; H01F 41/04; H01F 17/04; H01F 17/0006; H01F 2017/048
USPC ..... 336/200, 233, 223
See application file for complete search history.

(56) References Cited

U.S. PATENT DOCUMENTS

2002/0067237 A1* 6/2002 Nakata ..... H01F 27/29 336/212
2010/0259353 A1 10/2010 Saito et al.
2012/0072150 A1* 3/2012 Furukawa ..... G01B 7/00 702/65
2013/0093556 A1* 4/2013 Lim ..... H01F 27/29 336/200
2013/0249664 A1* 9/2013 Tonoyama ..... H01F 27/255 336/200
2013/0265131 A1* 10/2013 Yang ..... H01F 17/0013 336/192
2015/0364245 A1* 12/2015 Jang ..... H01F 27/2823 336/208
2016/0078996 A1* 3/2016 Li ..... H01F 27/2804 336/200
2016/0126006 A1 5/2016 Ahn
2016/0155556 A1* 6/2016 Ohkubo ..... H01F 41/043 336/83
2016/0307688 A1 10/2016 Park
2016/0351316 A1* 12/2016 Ohkubo ..... H01F 17/0006

FOREIGN PATENT DOCUMENTS

JP 2016-92422 A 5/2016
KR 10-1352935 B1 1/2014
KR 10-2016-0124322 10/2016

OTHER PUBLICATIONS

Notice of Office Action issued in Korean Patent Application No. 10-2017-0040688, dated Jun. 14, 2018 (English translation).
Notice of Office Action issued in Japanese Patent Application No. 2017-223962, dated Aug. 7, 2018 (English translation).

* cited by examiner

COIL COMPONENT AND METHOD FOR MANUFACTURING SAME

CROSS-REFERENCE TO RELATED APPLICATION

This application claims the benefit of priority to Korean Patent Application No. 10-2017-0040688, filed on Mar. 30, 2017 with the Korean Intellectual Property Office, the entirety of which is incorporated herein by reference.

BACKGROUND

The present disclosure relates to a coil component.

An inductor, such as a coil component, is a representative passive element commonly forming part of electronic circuits together with one or more resistors and capacitors to remove noise. For example, a power inductor may be used in a power circuit or a converter circuit in which a high level of current flows.

Winding-type coil components, which may be manufactured using a relatively simple method, have been increasingly used. However, coils may be caused to be biased during the manufacturing of such winding-type coil components, and the coils may thereby be exposed externally. As a result, defects in the exterior of a winding-type coil component and a deterioration in characteristics thereof may occur.

SUMMARY

An aspect of the present disclosure provides a coil component that allows a coil to be stably mounted therein even when manufacturing a compact coil component, and that facilitates mass production. A method for manufacturing the same is also provided.

One solution proposed by the present disclosure is to allow a plurality of guide members to be spaced apart from each other along an outer periphery of a winding coil.

According to an aspect of the present disclosure, a coil component may thus include a body having a winding coil and a plurality of guide members therein. The guide members may be spaced apart from each other along an outer periphery of the winding coil, and each of the guide members may have an exposed surface exposed externally of the body.

According to an aspect of the present disclosure, a method for manufacturing a coil component may include seating opposing ends of a winding coil on a support member of a frame including the support member and a plurality of guide members, the guide members restricting movement of the winding coil relative to the frame. A body is formed embedding the winding coil and at least a portion of each of the guide members therein.

According to another aspect of the present disclosure, a coil component includes a body, a winding coil disposed within the body, and a plurality of guide members disposed within the body and each extending to a respective side surface of the body. The plurality of guide members may be disposed such that at least one guide member is disposed between the winding coil and each side surface of the body in a cross-section of the body.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
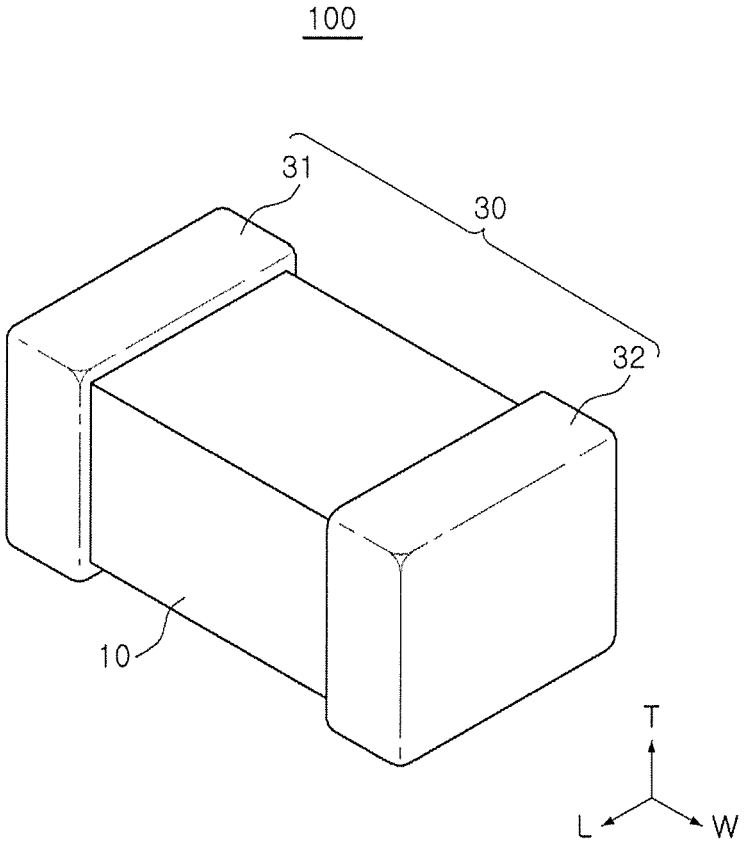
FIG. 1 is a perspective view of a coil component according to an exemplary embodiment.

Hereinafter, embodiments of the present disclosure will be described with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated, listed items.

It will be apparent that, although the terms 'first,' 'second,' 'third,' etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the exemplary embodiments.

Spatially relative terms, such as "above," "upper," "below," "lower," or the like, may be used herein for ease of description to describe one element's positional relationship relative to other element(s) in the illustrative orientation shown in the figures. It will be understood that such spatially relative terms are intended to encompass different orientations of the device in use or operation, in addition to the orientation depicted in the figures. For example, if the device in the figures is turned over, elements described as "above" or "upper" relative to other elements would then be oriented "below" or "lower" relative to the other elements or features. Thus, the term "above" can encompass both the above and below orientations, depending on a particular directional orientation of the figures or devices. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to the schematic views illustrating embodiments of the present disclosure shown in the attached drawings. In the drawings, for example due to manufacturing techniques and/or tolerances, modifications of the shapes shown may be estimated. Thus, embodiments of the present disclosure should not be construed as being limited to the particular shapes of regions shown herein, but should more generally be interpreted as including, for example, changes in shape resulting from manufacturing processes. The following embodiments may also be constituted alone or as a combination of several or all thereof.

The contents of the present disclosure described below may have a variety of configurations, and only a required configuration is proposed herein, but the present disclosure is not limited thereto.

A coil component, according to an exemplary embodiment, will be described hereinafter. For example, a power inductor will be described as the coil component for convenience. However, the present disclosure is not limited thereto. The contents of an exemplary embodiment may also be applied to a coil component for various different purposes. Examples of the coil component for various different purposes may include a high-frequency inductor, a common mode filter, a general bead, and a high frequency (GHz) bead.

FIG. 1 is a perspective view of a coil component 100 according to an exemplary embodiment.

In the following description described with reference to FIG. 1, a "length" direction may be defined as an "L" direction of FIG. 1, a "width" direction may be defined as a "W" direction of FIG. 1, and a "thickness" direction may be defined as a "T" direction of FIG. 1.

Referring to FIG. 1, the coil component 100, according to the exemplary embodiment, may include a body 10, a winding coil (not illustrated) disposed inside of the body 10, and an external electrode 30 disposed outside of the body 10.

The body 10 may form an exterior of the coil component 100. A shape of the body 10 may be substantially hexahedral, having two end surfaces opposing each other in the length direction, two side surfaces opposing each other in the width direction, and upper and lower surfaces opposing each other in the thickness direction, but is not limited thereto.

The body 10 may include a magnetic material. The magnetic material is not particularly limited as long as it has magnetic properties, and for example, may be Fe alloys such as a pure iron powder, an Fe—Si-based alloy powder, an Fe—Si—Al-based alloy powder, an Fe—Ni-based alloy powder, an Fe—Ni—Mo-based alloy powder, an Fe—Ni—Mo—Cu-based alloy powder, an Fe—Co-based alloy powder, an Fe—Ni—Co-based alloy powder, an Fe—Cr-based alloy powder, an Fe—Cr—Si-based alloy powder, an Fe—Ni—Cr-based alloy powder, or an Fe—Cr—Al-based Fe alloy, amorphous alloys such as an Fe-based amorphous alloy and a Co-based amorphous alloy, spinel-type ferrites such as a Mg—Zn-based ferrite, a Mn—Mg-based ferrite, a Cu—Zn-based ferrite, a Mg—Mn—Sr-based ferrite, and a Ni—Zn-based ferrite, hexagonal ferrites such as a Ba—Zn-based ferrite, a Ba—Mg-based ferrite, a Ba—Ni-based ferrite, a Ba—Co-based ferrite, and a Ba—Ni—Co-based ferrite, or garnet-type ferrites such as a Y-based ferrite and the like.

The magnetic material may include a mixture of magnetic metal powder particles and a resin. The magnetic metal powder particles may include iron (Fe), chromium (Cr), or silicon (Si) as a main ingredient. For example, the magnetic metal powder particles may include iron-nickel (FeNi), iron (Fe), iron-chromium-silicon (FeCrSi), or the like, but is not limited thereto. The resin may include an epoxy, a polyimide, a liquid crystal polymer (LCP), or a mixture thereof, but is not limited thereto. The magnetic metal powder particles may have at least two average particle sizes $D_1$ and $D_2$. In this case, a magnetic material-resin composite may be fully filled by using and compressing bimodal magnetic metal powder particles having different sizes, such that a packing factor of the magnetic material-resin composite may be increased.

The body 10 may be formed by forming the magnetic material-resin composite, containing the mixture of the magnetic metal powder particles and the resin, in a sheet shape and compressing and curing the sheet-shaped magnetic material-resin composite on and below a winding coil 20, but is not necessarily limited thereto. A stacking direction of the magnetic material-resin composite may be perpendicular to amounting surface of the coil component 100. Here, the term "perpendicular" is a concept including a case in which an angle between the stacking direction and the mounting surface is approximately 90°, for example, 60° to 120° or so, in addition to a case in which the angle is exactly 90°.

When the coil component 100 is mounted on a circuit board or the like, the external electrode 30 may electrically connect the coil component 100 to the circuit board or the like. The external electrode 30 may include first and second external electrodes 31 and 32 connected to a pair of lead portions 20*a* and 20*b* of the winding coil 20 (as shown in FIG. 2), respectively.

The external electrode 30 may include a metal having improved electrical conductivity. Examples of the metal may include silver (Ag), palladium (Pd), aluminum (Al), nickel (Ni), titanium (Ti), gold (Au), copper (Cu), platinum (Pt), tin (Sn), and alloys thereof.

Figure 2:
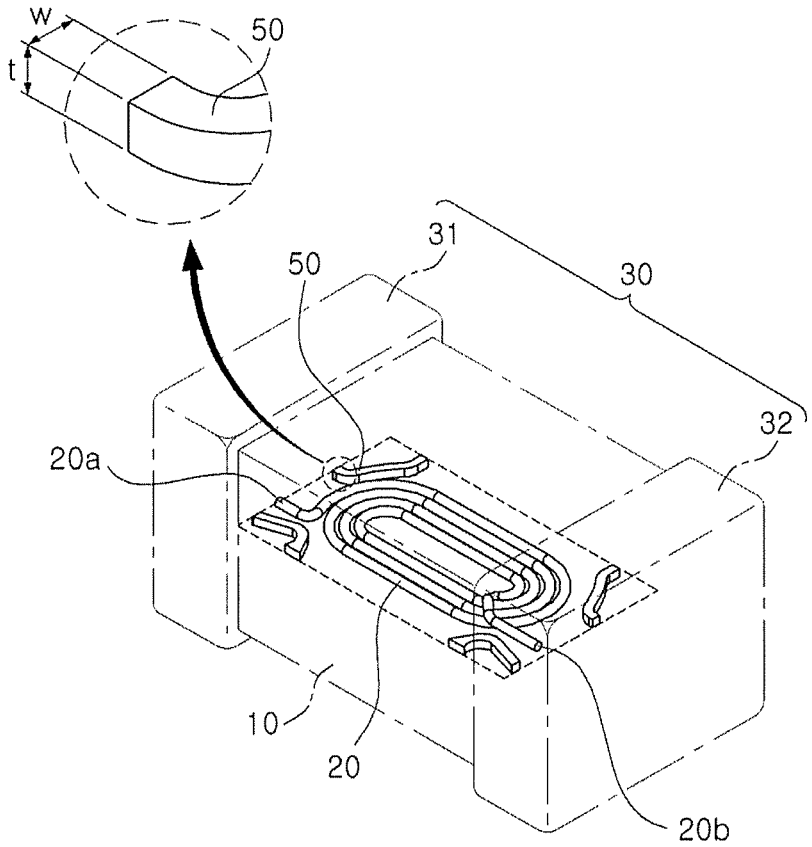
FIG. 2 is a projected perspective view showing a winding coil disposed in a body of the coil component of FIG. 1.
Figure 3C:
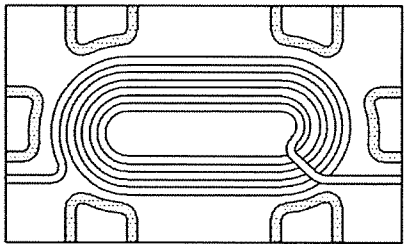
FIGS. 3A through 3E illustrate various modified examples of a guide member.
Figure 3B:
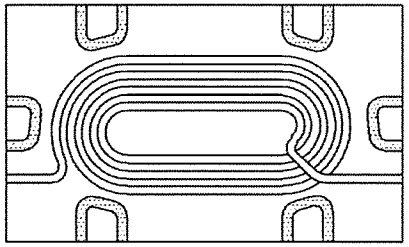
Figure 3A:
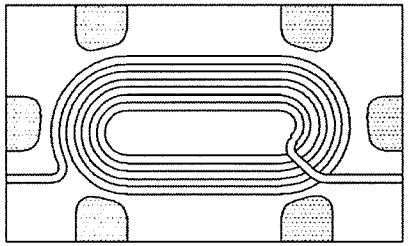
Figure 3E:
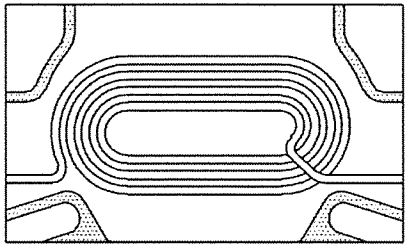
Figure 3D:
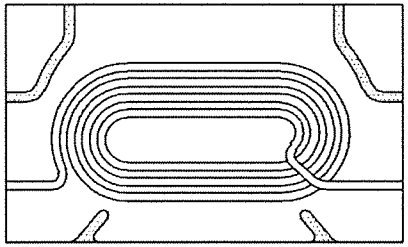

FIG. 2 is a projected perspective view of a winding coil 20 of the coil component 100 of FIG. 1.

Referring to FIG. 2, the body 10 may have the winding coil 20 and a plurality of guide members 50 disposed therein.

The winding coil 20 may perform various functions within the electronic device, using characteristics expressed from the winding coil 20. For example, when the coil component 100 is a power inductor, the winding coil 20 may store electricity in magnetic field form to maintain an output voltage, thus stabilizing power.

The winding coil 20 may be formed as a metal line, such as a copper (Cu) or silver (Ag) wire, and may include a pair of lead portions 20*a* and 20*b* exposed externally of the body 10. FIG. 2 illustrates the pair of lead portions 20*a* and 20*b* exposed to the opposing side surfaces of the body 10, respectively, but the present disclosure is not limited thereto.

The winding coil 20 is not limited to a single line, and may include a soft line or two or more lines. Further, the winding coil 20 is not limited to having a circular cross-sectional shape, and may also have various other cross-sectional shapes, such as a quadrangular shape.

The winding coil 20 may be coated with an insulating layer (not illustrated), thus providing electrical insulation between the winding coil 20 and other components (e.g., the body 10).

The guide members 50 may restrict movements of the winding coil 20 at the time of manufacturing the coil component 100. The guide members 50 may include a plurality of guide members 50. Such guide members 50 may be spaced apart from each other along an outer periphery of the winding coil 20. In an exemplary embodiment, the guide members 50 may be spaced apart from each other along the outer periphery of the winding coil 20 to significantly reduce positional bias or skew of the winding coil at the time of manufacturing the coil component, thus preventing the winding coil 20 from being exposed externally of the coil component 100. Further, the limit of dicing margin due to miniaturization of the coil component may be overcome.

As discussed below, the coil component 100, according to an exemplary embodiment, may be manufactured using a frame. Accordingly, each of the guide members 50 may have an exposed surface exposed externally of the body 10, and the exposed surface may be formed as a cut surface. As a volume of each of the guide members 50 increases, a reduction in capacity of the winding coil 20 due to a loss of a magnetic material region may be caused. In an exemplary embodiment, the coil component 100 may be manufactured using the frame, thus significantly reducing the volume of each guide member 50. As a result, the reduction in capacity of the winding coil 20 may be significantly reduced.

Each guide member 50 may be designed to be indirect contact with the outer periphery of the winding coil 20 without tolerance. Thus, movements of the winding coil 20 may be perfectly restricted. However, ease of manufacturing may be somewhat reduced.

The guide members 50 may be designed, such that the guide members 50 may have a constant tolerance with respect to the outer periphery of the winding coil 20. For example, at least a portion of the guide members 50 may not be in contact with the winding coil 20, even when movements of the winding coil 20 occur. Thus, the coil component 100 may be easily manufactured.

The number of the guide members 50 is not particularly limited, and may be, for example, 4 to 16. When the number of the guide members is less than 4, the risk of allowing the winding coil 20 to be exposed to a side surface of the body 10 in the manufacturing process of the coil component may occur. In contrast, when the number of the guide members exceeds 16, a reduction in capacity in the winding coil 20 due to a loss of the magnetic material region may occur.

A width w of the guide member 50 is not particularly limited, and may be, for example, 0.03 mm to 0.3 mm. When a width w of the guide member 50 is less than 0.03 mm, it may be difficult to impart an appropriate degree of rigidity to the winding coil 20. In contrast, when the width w of the guide member 50 exceeds 0.3 mm, a reduction in capacity due to a loss of the magnetic material region may occur.

A thickness t of the guide member 50 is not particularly limited, and may be, for example, 0.03 mm to 0.3 mm. When the thickness t of the guide member 50 is less than 0.03 mm, it may be difficult to impart an appropriate degree of rigidity to the winding coil 20. In contrast, when the thickness t of the guide member 50 exceeds 0.3 mm, a reduction in capacity due to a loss of the magnetic material region may occur.

A material of the guide member 50 is not particularly limited as long as the winding coil 20 may be imparted with an appropriate degree of rigidity in the manufacturing process of the coil component 100. For example, the guide member 50 may include a metallic material such as copper (Cu), nickel (Ni), iron (Fe), tin (Sn), or alloys thereof, a printed circuit board (PCB) material such as a phenol-based resin, or a ceramic material.

FIGS. 3A through 3E illustrate various modified examples of a guide member. As can be seen from FIGS. 3A through 3E, a detailed shape and position of the guide member 50, according to an exemplary embodiment, is not particularly limited. As shown, differently shaped guide members 50 can be used within a same body 10. Guide members 50 can take the form of wires, plates, plates with holes extending therethrough, or the like.

FIGS. 4 through 8 are drawings illustrating sequential steps of a process of manufacturing the coil component 100 of FIG. 1. Hereinafter, descriptions overlapping previously provided descriptions will be omitted, and each operation of a schematic manufacturing process of the coil component 100 will be described.

Figure 4:
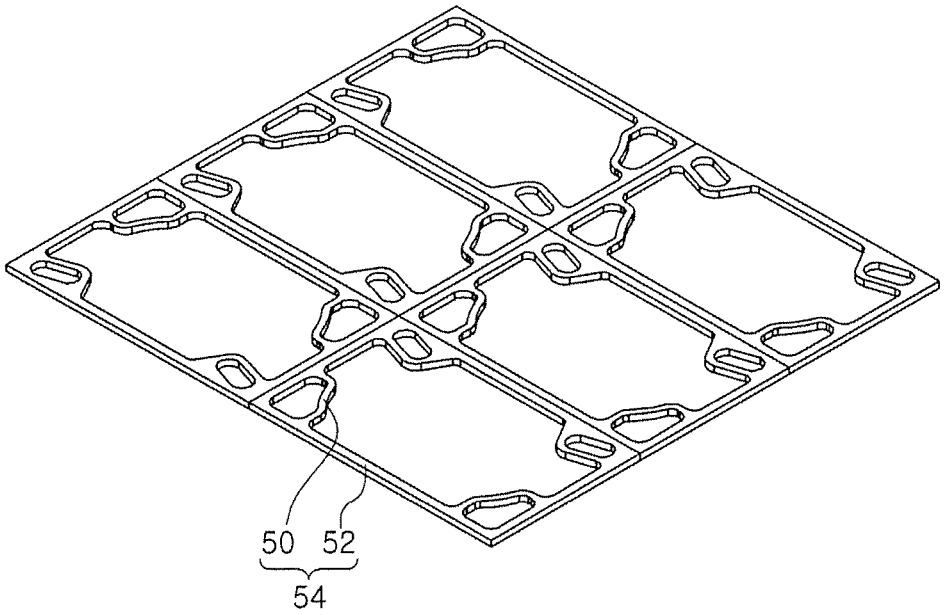
FIGS. 4 through 8 are drawings illustrating sequential steps of a process of manufacturing the coil component of FIG. 1.

Referring to FIG. 4, a frame 54 may be provided. The frame 54 may include a support member 52 on which opposing ends of a winding coil 20 can be seated (see, e.g., FIG. 5). The frame further includes a plurality of guide members 50 extending from the support member 52 and used for suppressing movements of the winding coil 20.

The guide members 50 and the support member 52 forming the frame 54 may be integrated with each other (e.g., integrally formed with each other). Thus, even when the guide members 50 are pressurized due to movements of the winding coil 20 in the manufacturing process of the coil component 100 (e.g., when force is applied to the guide members 50, for example as a result of force being applied to the winding coil 20 which contacts and pushes the guide members 50), displacement of the guide members 50 does not occur. However, the guide members 50 and the support member 52 are not necessarily limited thereto, and may also be bonded to each other by an adhesive or the like.

A material of the frame 54 is not particularly limited as long as the winding coil 20 may be imparted with an appropriate degree of rigidity (e.g., held in place with an appropriate degree of rigidity) in the manufacturing process of the coil component 100. For example, the frame 54 may include a metallic material such as copper (Cu), nickel (Ni), iron (Fe), tin (Sn), or alloys thereof, a printed circuit board (PCB) material such as a phenol-based resin, or a ceramic material.

Figure 5:
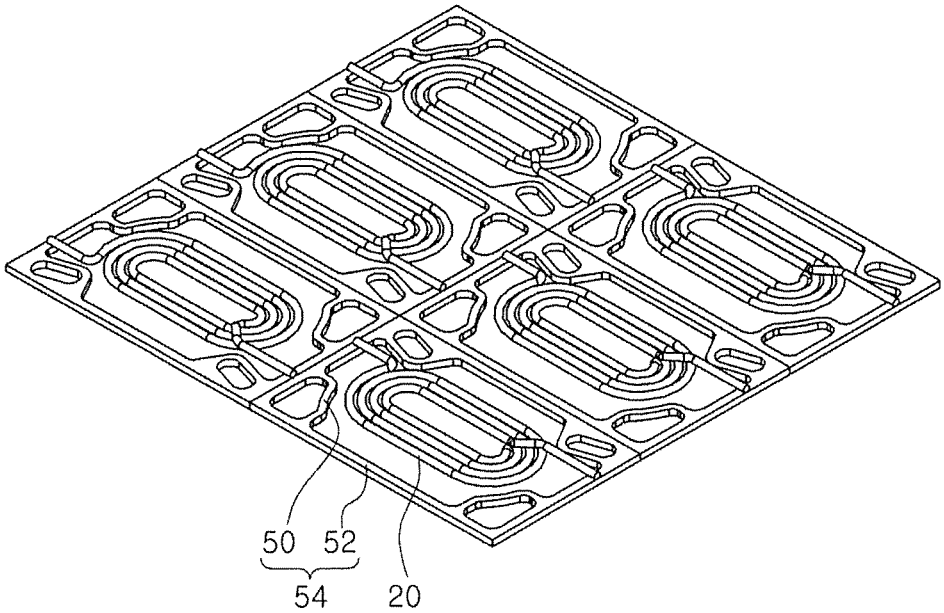

Referring to FIG. 5, the opposing ends of the winding coil 20 may be seated on the support member 52. The guide members 50 may be spaced apart from each other along the outer periphery of the winding coil 20.

As illustrated in FIG. 5, a plurality of winding coils 20 may be loaded on a plurality of frames 54, respectively, thus facilitating mass production.

Although not illustrated in the drawings, after the seating process, the opposing ends of the winding coil 20 may be fixed to the support member 52 with an adhesive film. Thus, an occurrence of movements of the winding coil 20 may be significantly reduced in a body formation operation to be described below.

Subsequently, a body may be formed such that the winding coil 20 and at least a portion of each of the guide members 50 may be embedded in the body.

Figure 6:
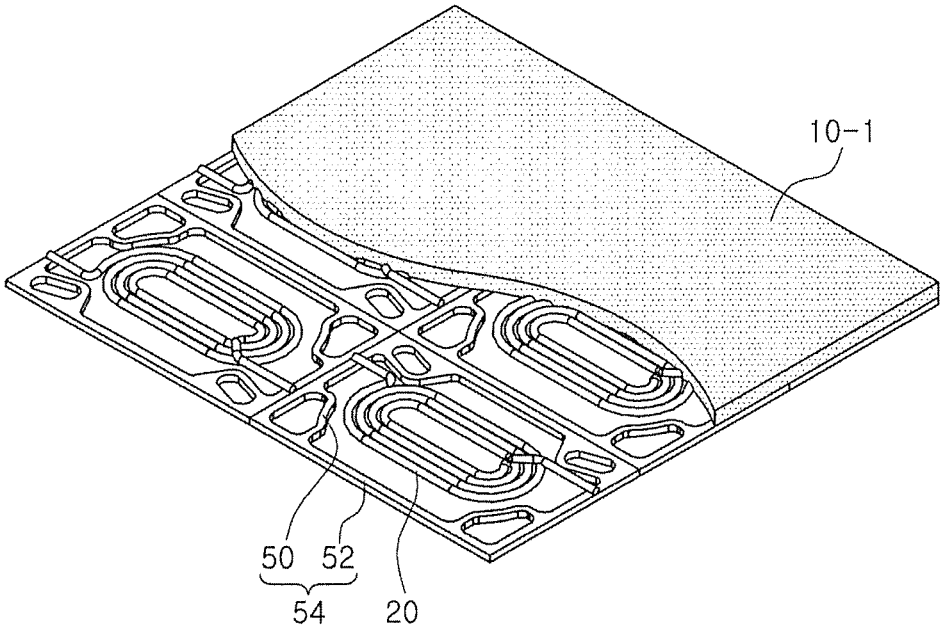

Referring to FIG. 6, a first magnetic sheet 10-1 may be compressed against one surface of the winding coil 20. The first magnetic sheet 10-1 may include a magnetic material-resin composite formed in a sheet shape, and may be compressed in a semicured state. The magnetic material-resin composite may be a mixture of magnetic metal powder particles and a resin. The magnetic metal powder particles may include Fe, Cr, or Si as a main ingredient, and the resin may include an epoxy, a polyimide, a liquid crystal polymer (LCP), or a mixture thereof, but is not limited thereto. The compression of the first magnetic sheet 10-1 may cause a peripheral space of a core portion of the winding coil 20, or the like to be filled with a magnetic material such as a magnetic material-resin composite or the like. Subsequently, the first magnetic sheet 10-1 may be subjected to a curing process to prevent bias of the winding coil 20 disposed in a predetermined position and to control bar deformation due to movements of the first magnetic sheet 10-1.

Figure 7:
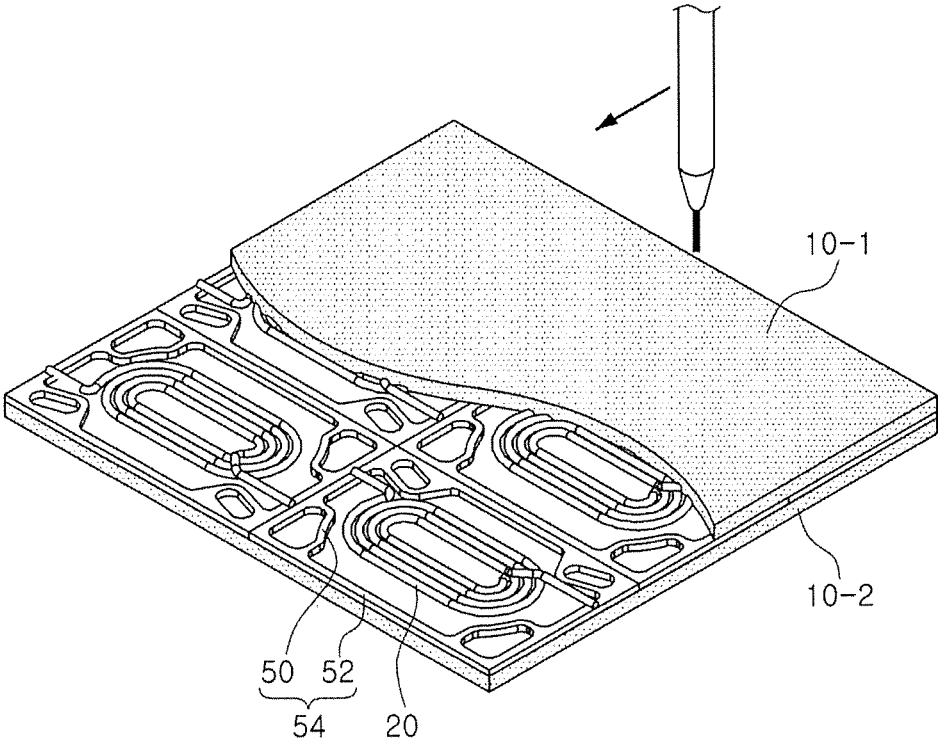

Referring to FIG. 7, a second magnetic sheet 10-2 may be compressed against the other surface of the winding coil 20. The second magnetic sheet 10-2 may also include a magnetic material-resin composite formed in a sheet shape, and may be compressed in a semicured state. Subsequently, the second magnetic sheet 10-2 may be subjected to a curing process to prevent bias of the winding coil 20 disposed in the predetermined position and to control bar deformation due to movements of the second magnetic sheet 10-2. The curing process of each of the first magnetic sheet 10-1 and the second magnetic sheet 10-2 may be conducted simultaneously or separately (e.g., sequentially).

Figure 8:
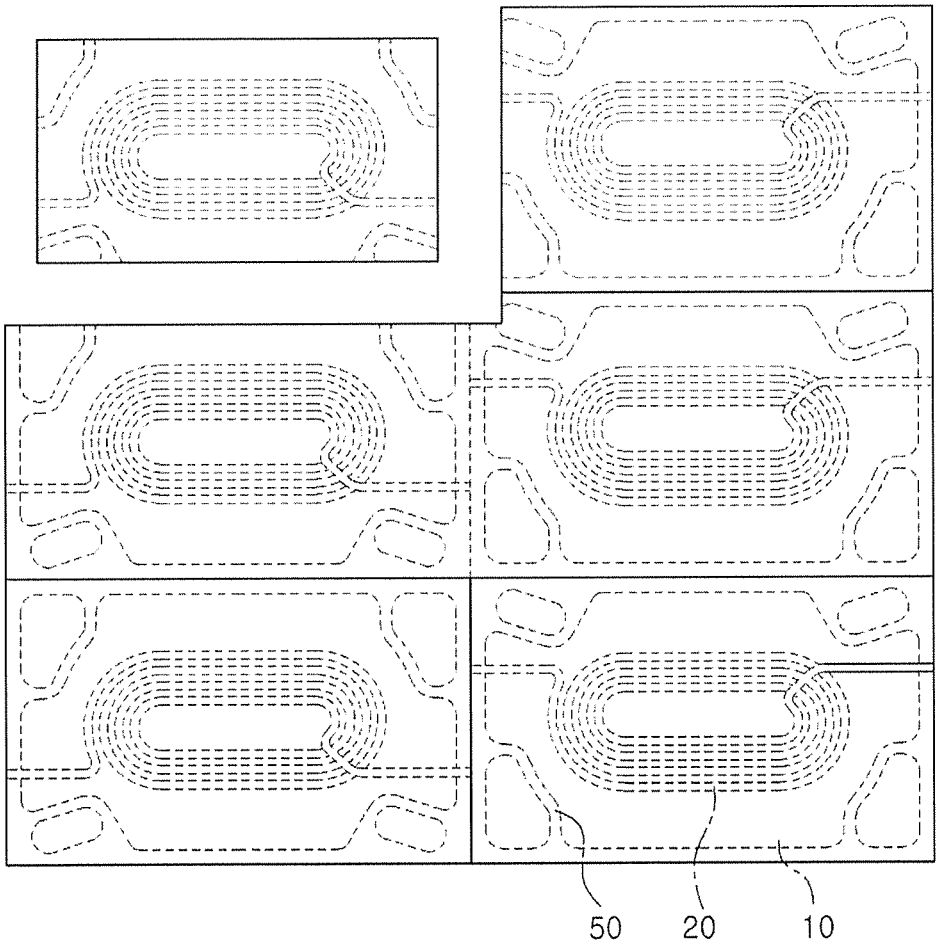

Referring to FIG. 8, the body 10 may be diced from the support member 52. The dicing process may be conducted to form coil components according to a predetermined/desired body size. As a result, an individual coil component 100 may be formed. Dicing equipment may be used in the dicing process to form the individual coil component 100, and other dicing tools such as a blade or a laser may also used. The support member 52 may be removed from the ultimate coil component 100 as part of the dicing process, and only at least a portion of the guide member 50 may be left inside the body 10 when the dicing process is complete.

Although not illustrated in the drawings, a grinding process may be conducted to grind an edge of the individual coil component 100 after the dicing process. Using the grinding process, the body 10 of the coil component 100 may be rounded, and an additional process of printing a surface of the body 10 with an insulating material may be conducted to prevent plating. The insulating material may include at least one of a glass-based material, including Si, an insulating resin, and plasma.

Further, the formation of an uneven portion on a surface of the diced body 10 may be significantly reduced to prevent the spread of plating, thus avoiding a concentration of a plating current at the time of applying the plating current to the body 10. For example, the body 10 may have a hemispherical shape in which a surface thereof, exposed by dicing the body 10 formed of the magnetic metal powder particles, is planarized, or a shape in which a portion of sphere is cut, such that the surface of the body 10 may be flat, thus preventing the concentration of the plating current when applying the plating current to the body 10.

Subsequently, the first and second external electrodes 31 and 32, respectively connected to the lead portions 20*a* and 20*b* of the winding coil 20, may be formed on external surfaces of the body 10 diced from the support member 52.

As set forth above, according to the exemplary embodiments, a winding coil may be stably disposed even in a compact coil component, thus achieving improved productivity.

While exemplary embodiments have been shown and described above, it will be apparent to those skilled in the art that modifications and variations could be made without departing from the scope of the present disclosure, as defined by the appended claims.

What is claimed is:

1. A coil component, comprising:

a body having a winding coil wound around a coil axis and a plurality of guide members therein, wherein the guide members are spaced apart from each other and from the winding coil along an outer periphery of the winding coil, each of the guide members has two ends that are exposed externally of the body and that are spaced apart from each other by a portion of the body on one or more external surfaces of the body, upper and lower surfaces of each of the guide members oppose each other in a direction of the coil axis, and the entire upper and lower surfaces contact the body, and a thickness of each guide member ranges from 0.03 mm to 0.3 mm.

2. The coil component of claim 1, wherein each guide member is conductive.

3. The coil component of claim 1, wherein the number of the guide members in the body of the coil component is 4 to 16.

4. The coil component of claim 1, wherein a width of each guide member ranges from 0.03 mm to 0.3 mm.

5. The coil component of claim 1, wherein the guide members are composed of a metallic material, a printed circuit board (PCB) material, or a ceramic material.

6. The coil component of claim 1, wherein the body is composed of a magnetic material-resin composite, comprising a mixture of magnetic metal powder particles and a resin, disposed on and below the winding coil, between the guide members and the winding coil, and between the two ends of the guide members.

7. The coil component of claim 1, further comprising first and second external electrodes disposed on external surfaces of the body while being respectively connected to first and second lead portions of the winding coil.

8. A coil component, comprising:

a body;

a winding coil disposed within the body; and a plurality of guide members composed of a conductive material, disposed within the body, and each extending to a respective side surface of the body, wherein each guide member is electrically insulated from the winding coil, the plurality of guide members are disposed between an outer periphery of the winding coil and external surfaces of the body, a portion of each guide member is spaced apart from the respective side surface of the body by a portion of the body, and a thickness of each guide member ranges from 0.03 mm to 0.3 mm.

9. The coil component of claim 8, wherein each guide member has a width and a thickness of less than 0.3 mm.

10. The coil component of claim 8, wherein the coil component includes at least four guide members disposed therein.

11. The coil component of claim 8, wherein the body is composed of a magnetic material-resin composite, comprising a mixture of magnetic metal powder particles and a resin, and the magnetic material-resin composite extends in spaces between the portion of each guide member and the respective side surface of the body.

12. A coil component, comprising:

a body having a winding coil wound around a coil axis and a plurality of guide members therein, wherein the guide members are independent from each other and spaced apart from each other in the body between the winding coil and respective side surfaces of the body, the body comprises a composition including magnetic material that is disposed between each guide member and an outer periphery of the winding coil, upper and lower surfaces of each of the guide members oppose each other in a direction of the coil axis, and the entire upper and lower surfaces contact the body, and a thickness of each guide member ranges from 0.03 mm to 0.3 mm.

13. The coil component of claim 12, wherein at least one guide member is not in contact with the winding coil.

14. The coil component of claim 12, wherein the number of the guide members in the body of the coil component is 4 to 16.

15. The coil component of claim 12, wherein a width of each guide member ranges from 0.03 mm to 0.3 mm.

16. The coil component of claim 12, wherein the guide members are composed of a conductive material.

17. The coil component of claim 12, wherein the guide members are composed of a printed circuit board (PCB) material or a ceramic material.

18. The coil component of claim 12, wherein the body is composed of the composition including magnetic material and comprises a mixture of magnetic metal powder particles and a resin, disposed above and below the winding coil and between the guide members and the winding coil.

19. The coil component of claim 12, further comprising first and second external electrodes disposed on external surfaces of the body while being respectively connected to first and second lead portions of the winding coil.

* * * * *